United States Patent [19]

Imai et al.

[11] 4,173,133

[45] Nov. 6, 1979

[54] CONTINUOUS ROLLING MILL

[75] Inventors: Isao Imai, Yokohama; Hiroyuki Shiozaki, Yokosuka, both of Japan

[73] Assignee: Ishikawajima-Harima Jukogyo Kabushiki Kaisha, Tokyo, Japan

[21] Appl. No.: 880,935

[22] Filed: Feb. 24, 1978

[30] Foreign Application Priority Data

Feb. 28, 1977 [JP] Japan ..... 52-21344

[51] Int. Cl.[2] ..... B21B 37/06

[52] U.S. Cl. ..... 72/8; 72/11; 72/205

[58] Field of Search ..... 72/8–12, 72/17, 205, 199, 366, 234

[56] References Cited

U.S. PATENT DOCUMENTS 3,823,593 7/1974 Vadrin et al. ..... 72/205

*Primary Examiner*—Milton S. Mehr

*Attorney, Agent, or Firm*—Scrivener, Parker, Scrivener & Clarke

[57] ABSTRACT

A continuous rolling mill capable of rolling a sheet metal under a reduced rolling force without wrapping it around work rolls wherein, at each of rolling stands, the upper and lower work rolls are rotated at different peripheral speeds in such a way that the peripheral speed of one of said pair of rolls which is rotated faster than the other may be substantially equal to the velocity of the metal sheet leaving said pair of rolls while the peripheral speed of said other roll which is rotated slower than said one roll may be substantially equal to the velocity of the metal sheet entering the pair of rolls.

1 Claim, 6 Drawing Figures

CONTINUOUS ROLLING MILL

DETAILED DESCRIPTION OF THE INVENTION

The present invention relates to generally a continuous rolling mill and more particularly a continuous rolling mill wherein the peripheral speeds of two work rolls are varied in such a way that the slower peripheral speed of one work roll is made equal to the velocity of a stock entering the rolls while the faster peripheral speed of the other work roll is made equal to the velocity of the stock leaving the work rolls, whereby the reduction of a stock having a greater width may be effected.

In rolling metal into sheets, the reduction in rolling load is essential for the reduction in size of rolling mills, in wear of rolls and in edge drop and for the reduction of hard materials and especially hard metal materials having a greater width.

In general, the reduction of metal into a sheet c is attained by a pair of work rolls a and b which have the same diameter and rotate at the same velocity as shown in FIG. 1. Since the peripheral speeds of the work rolls a and b are equal, the neutral points $N_1$ and $N_2$ are on the same vertical line where the sheet velocity is equal to the peripheral speeds. At the roll bite portion indicated by the hatched area, the friction forces are directed as indicated by the arrows for pulling the metal piece into the rolls so that the sheet c is subjected to the horizontal compression force and the vertical reduction load becomes higher than when there is no friction force.

In a rolling mill shown in FIG. 2, the peripheral speeds of the work rolls a and b are different. That is, the slower work roll b rotates at a peripheral speed $V_O$ while the faster work roll a, at $V_1$. The rolling is effected under the condition $$V_1/V_O < h_O/h_1$$

where $h_O$ = the thickness of the metal entering the work rolls, and $h_1$ = the thickness of the sheet leaving the work rolls.

In this rolling system, the lower and upper neutral points $N_1$ and $N_2$ are offset and are located on the arcs of contact so that the frictional forces between the lower work roll b and the metal c are directed opposite to the frictional forces between the upper work roll a and the metal c as indicated by the arrows. As a result there is a zone c' which is not subjected to the horizontal compression, but ahead and after of this zone c' rolling conditions are similar to those of the rolling system shown in FIG. 1. Thus the rolling load may be considerably reduced as compared with the rolling system shown in FIG. 1.

According to the recently developed rolling drawing or RD process, the rolling load may be considerably reduced so that the above described objects may be attained. That is, RD process is effected under the condition of $$V_1/V_O = h_O/h_1$$

where $V_O$ = the velocity of the slower work roll b and the velocity $V_O$ of the material entering the rolls, $V_1$ = the velocity of the faster work roll a and the the velocity $v_1$ of the metal leaving the rolls, $h_O$ = the thickness of the metal entering the rolls, and $h_1$ = the thickness of the metal leaving the rolls.

The neutral points $N_1$ and $N_2$ are also offset. That is, the lower neutral point $N_1$ coincides with the entering point while the upper neutral point $N_2$ coincides with the exit point as shown in FIG. 3. Therefore the upper frictional forces and the lower frictional forces are opposite in direction so that the metal is not subjected to the horizontal compression and the rolling load is independent of the frictional forces and is considerably reduced, whereby the above described objects may be attained.

However RD process has a problem that it is extremely difficult to make the neutral points $N_1$ and $N_2$ coincident with the entering point and the exit point, respectively. To overcome this problem, as shown in FIG. 4 the metal c is partly wrapped around both the upper and lower work rolls a and b at a suitable subtended or wrapping angle $\theta$ so that the frictional forces between the upper and lower work rolls a and b may be utilized to attain the conditions of $$v_O = V_O \text{ and } v_1 = V_1.$$

When the metal c is wrapped around the upper and lower work rolls of the two-high-rolling-mill and when it is assumed that the tension $t_O$ at the entering point to the mill and the tension $t_1$ at the exit point from the mill be maintained constant, the tension $t_b$ at the point entering to the roll bite zone x and the tension $t_f$ at the point leaving the roll bite zone x may be variable within the following ranges:

$$t_O e^{-\mu\theta} \leqq t_b \leqq t_O e^{\mu\theta}$$

$$t_1 e^{-\mu\theta} \leqq t_f \leqq t_1 e^{\mu\theta}$$

where $\mu$ = coefficient of friction between the work roll a, b and metal c, and e = the base of natural logarithms.

Therefore the automatic thickness adjustment by tension may be attained against the roll eccentricity and other external disturbances so that the stable rolling may be effected. Furthermore the above condition $$V_1/V_O = h_O/h_1$$

is satisfied so that the upper and lower frictional forces are opposite in direction. As a result the rolling load is independent from the frictional forces and may be reduced.

However since the metal must be wrapped around the work rolls in RD process, the metal sheet e must be threaded from an uncoiler f to a recoiler g through work rolls d as shown in FIG. 5 in case of a tandem roll mill. Therefore there arise the following problems:

(1) it is difficult to pass the metal sheet;

(2) since no backing roll an be used, the work rolls are subjected to a considerable degree of bending; and (c) surface flaws are frequently produced.

In view of the above, one of the objects of the present invention is to provide a continuous rolling mill which may accomplish continuous rolling with the considerably reduced rolling load as in RD process but without the need of wrapping a metal sheet around work rolls.

Another object of the present invention is to provide a continuous rolling mill wherein the ratio of the roll velocity to the sheet velocity may be correctly yet easily controlled.

The above and other objects, features and advantages of the present invention will become apparent from the following description of one preferred embodiment thereof taken in conjunction with FIG. 6 of the accompanying drawings, in which.

Figure 6:
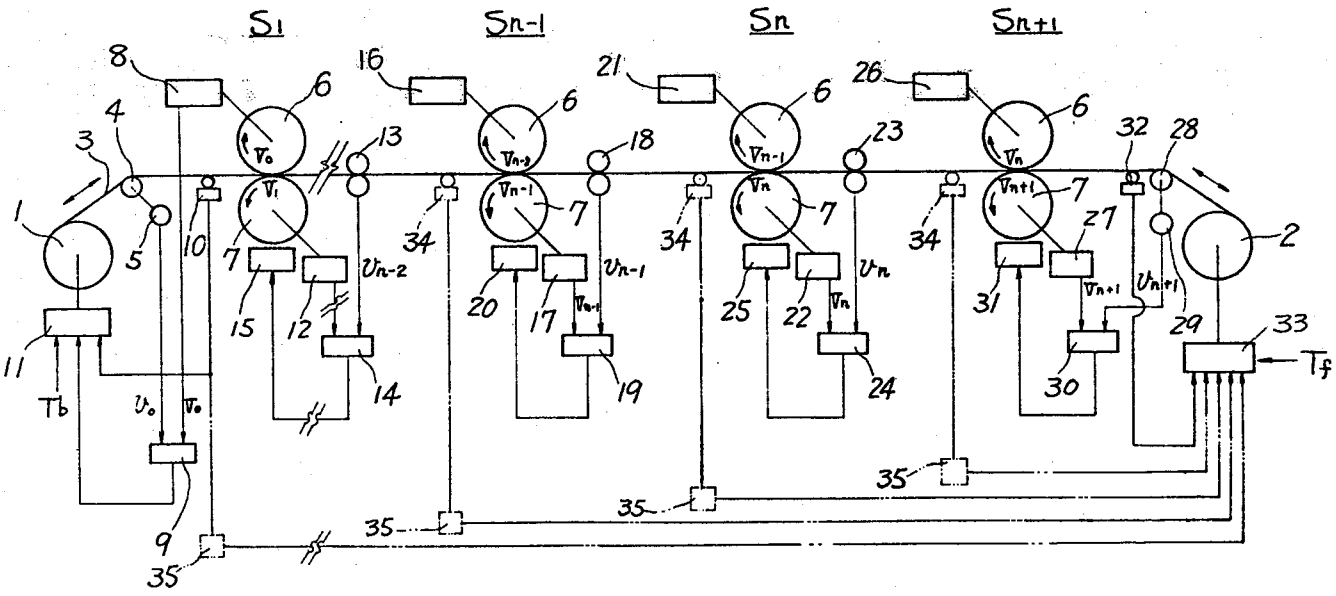
FIG. 6 is a schematic view of a continuous rolling mill in accordance with the present invention.

Referring to FIG. 6, a metal sheet 3 is uncoiled from an uncoiler 1, passes a pinch roll 4, a plurality of stands $S_1$–$S_{n+1}$ each consisting of an upper roll 6 and a lower roll 7 and a deflector roll 28 and is coiled again by a recoiler 2.

A velocity detector 5 is operatively coupled to the deflector roller 4 for detecting the velocity $V_O$ of the sheet metal 3 entering the work rolls 6 and 7 in the first stand $S_1$, and the output from the velocity detector 5 is applied to a velocity comparator 9. The velocity $V_O$ of the upper work roll 6 in the first stand $S_1$ is controlled by a first velocity control unit 8 including a motor and an upper roller velocity detector (not shown), and the output representative of the velocity $V_O$ from the velocity control unit 8 is applied to the velocity comparator 9 and is compared with the output from the sheet metal velocity detector 5. The difference output signal from the velocity comparator 9 is applied to a tension control unit 11.

A tension gage 10 is disposed adjacent to the entering point to the first stand $S_1$ for sensing the tension of the sheet metal 3 entering the working rolls 6 and 7 in the first stand $S_1$, and the output from the tension gage 10 representative of the detected tension is applied to the tension control unit 11.

In response to a preset tension signal $T_b$, the output signal from the velocity comparator 9 and the output from the tension gage 10, the tension controll unit 11 controls the uncoiler 1 so that the tension of a predetermined degree may be always exerted to the sheet metal 3.

A first lower work roll velocity control unit 12 controls the velocity $V_1$ of the lower work roll 7 in the first stand $S_1$, the velocity $V_1$ being faster than the velocity $V_O$ of the upper work roll 6. The output representative of the velocity $V_1$ from the velocity control unit 12 is applied to a first lower work roll velocity comparator 14.

A sheet metal velocity detector 13 is disposed downstream of the first stand $S_1$ for detecting the velocity of the sheet metal 3 leaving from the rolls 6 and 7, and the output from the velocity detector 13 is applied to the lower work roll velocity comparator 14. The difference output signal from the comparator is applied to a reduction control unit 15 which in turn controls the reduction pressure or the gap between the work rollers 6 and 7 in such a way that the lower work roll velocity $V_1$ may be always equal to the velocity of the sheet metal 3 leaving the rolls 6 and 7 in the first stand $S_1$.

The stands $S_{n-1}$, $S_n$ and $S_{n+1}$ are substantially similar in construction to each other and to the first stand $S_1$. That is, each stand is provided with a ($S_{n-1}$, $S_n$ or $S_{n+1}$)-th upper work roll velocity control unit 16, 21 or 26 which controls the velocity $V_{n-2}$, $V_{n-1}$ or $V_n$ of the upper work roller 6 so that the velocity of the upper work roll in respective stands may be equal to the velocity of the lower work roll in the preceding stand.

The respective stand is also provided with a lower work roll velocity control unit 17, 22 or 27 for maintaining the velocity of the lower work roll 7 at a predetermined velocity $V_{n-1}$, $V_n$ or $V_{n+1}$ which is faster than the velocity $V_{n-2}$, $V_{n-1}$ or $V_n$ of the upper work roll 6. The output representative of the lower work roll velocity from the lower work roll velocity control unit 17, 22 or 27 is applied to a lower work roll velocity comparator 19, 24 or 30.

A velocity detector 18, 23 or 29 is disposed for sensing the velocity of the sheet metal 3 leaving the rolls 6 and 7 from the respective stand, and the output from the velocity detector 18, 23 or 28 is applied to the lower work roll velocity comparator 19, 24 or 30, and the difference output signal from the lower work roll velocity comparator 19, 24 or 30 is applied to a reduction control unit 20, 25 or 31 which controls the reduction pressure or the gap between the work rolls 6 and 7 in such a way that the velocity of the lower work roll 7 may be always maintained equal to the velocity of the sheet metal leaving the work rolls 6 and 7 in the respective stands.

The sheet metal velocity detector 29 in the last stand $S_{n+1}$ is operatively coupled to the deflector roll 28. A tension gage 32 is disposed at the downstream of the work rolls 6 and 7 of the last stand $S_{n+1}$, and the output from the gage 32 is applied to a tension control unit 33. In response to this output and a preset tension signal $T_f$ the tension control unit 33 controls the recoiler 2 so that the latter may maintain the tension of the sheet metal 3 at a predetermined degree.

In the operation the upper and lower work rolls 6 and 7 are so controlled as to rotate at different velocities in such a way that the ratio of the velocity of the lower work roll to the velocity of the upper work roll is equal to the reduction or elongation ratio of the thickness of the sheet metal entering the work rolls to the thickness of the sheet metal leaving the work rolls and that the velocity ratio may be equal to the ratio of the velocity of the sheet metal leaving the work rolls to the velocity of the sheet metal entering the work rolls. That is, at the first stand $S_1$, $$v_1/v_O = V_1/V_O = h_O/h_1 = \lambda_1, \text{ and}$$

$$v_O = V_O \text{ and } v_1 = V_1$$

where $v_1$ = the velocity of the sheet metal entering the work rolls, $v_O$ = the velocity of the sheet metal leaving the work rolls, $V_O$ = the velocity of the upper or slower work roll 6, $V_1$ = the velocity of the lower or faster work roll 7, $\lambda_1$ = the reduction or elongation ratio, $h_O$ = the thickness of the metal entering the work rolls and $h_1$ = the thickness of the metal leaving the work rolls;

at the (n−1)-th stand $S_{n-1}$, $$v_{n-1}/v_{n-2}=V_{n-1}/V_{n-2}=h_{n-2}/h_{n-1}=\lambda_{n-1},$$

and $$v_{n-2}=V_{n-2} \text{ and } v_{n-1}=V_{n-1};$$

at the n-th stand $S_n$, $$v_n/v_{n-1}=V_n/V_{n-1}=h_{n-1}/h_n=\lambda_n, \text{ and}$$

$$v_{n-1}=V_{n-1} \text{ and } v_n=V_n; \text{ and}$$

at the (n+1)-th stand $S_{n+1}$, $$v_{n+1}/v_n=V_{n+1}/V_n=h_n/h_{n+1}=\lambda_{n+1}; \text{ and}$$

$$v_n=V_n \text{ and } v_{n+1}=V_{n+1}.$$

Figure 1:
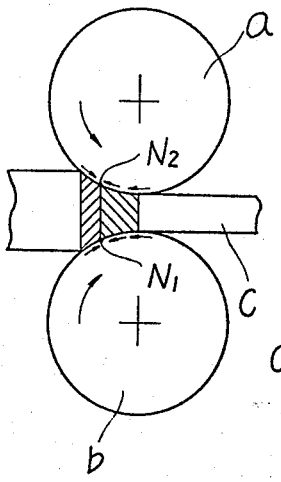
PRIOR ART Fig. 1
FIG. 1 is a view used for the explanation of a prior art rolling system wherein metal is rolled by a pair of work rolls having the same diameter and rotating at the same velocity.
Figure 2:
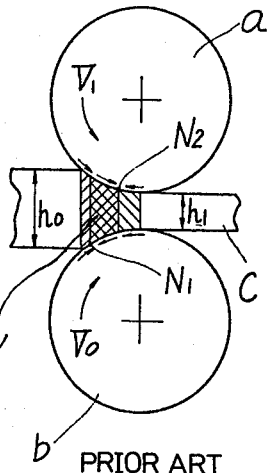
PRIOR ART Fig. 2
FIG. 2 is a view used for the explanation of a prior art rolling system wherein the velocities of the upper and lower work rolls are different.
Figure 3:
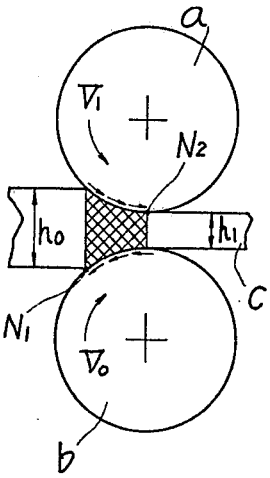
PRIOR ART Fig. 3
FIG. 3 is a view used for the explanation of the fundamental principle of RD process.
Figure 4:
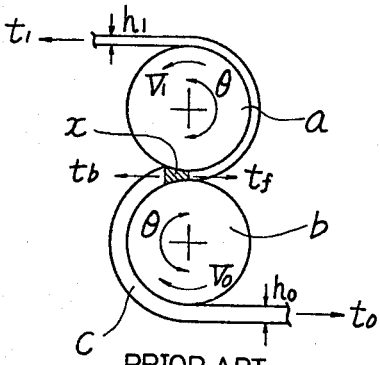
PRIOR ART Fig. 4
FIG. 4 is a view used for the explanation of RD process wherein the metal sheet is partly wrapped around the work rolls.
Figure 5:
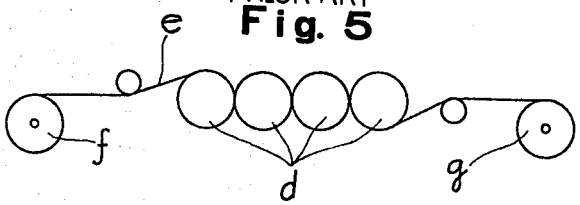
PRIOR ART Fig. 5
FIG. 5 is a schematic view of a tandem rolling mill when RD process is employed.

When the above conditions are satisfied, the lower neutral point may be made coincidence with the entering point while the upper neutral point, with the exit point as shown in FIG. 3 as in RD process by the tensions exerted to the sheet metal 3 from the uncoiler 1 and the recoiler 2, whereby the continuous rolling may be effected with a small rolling force without accompanying with rolling friction hill.

The mode of operation of the continuous rolling mill with the above construction will be described in more detail hereinafter. In response to the output representative of the tension detected by the tension gage 32 and the preset tension signal $T_f$ the tension control unit 33 controls the recoiler 2 so that a predetermined tension may be always exerted to the sheet metal 3. At the (n+1)-th stand, the upper velocity control unit 26 maintains the velocity of the upper work roll at $V_n$ while the lower velocity control unit 27 maintains the velocity of the lower work roll 7 at $V_{n+1}$ which is faster than the velocity $V_n$. (Of course the velocity of the upper roll 6 may be faster than that of the lower roll 7.) The output from the velocity control unit 27 and the output from the velocity detector 29 are compared by the velocity comparator 30, and the difference output from the comparator is applied to the reduction control unit 31. When there is no difference between the velocity of the lower work roll 7 and the velocity of the sheet metal 3 leaving the work rolls 6 and 7, $V_{n+1}=v_{n+1}$, but when there is a difference between them, the reduction control unit 31 controls the reduction pressure or the gap between the work rolls in such a way that there is no difference between the outputs from the lower work roll velocity control unit 27 and the sheet metal velocity detector 29.

Thereafter the velocities of the upper and lower work rolls 6 and 7 at the n-th stand $S_n$ are controlled in a manner substantially to that described above. That is, the upper velocity control unit 21 maintains the velocity of the upper work roll 6 at $V_{n-1}$ while the lower velocity control unit 22 maintains the lower work roll 7 at $V_n$ which is faster than $V_{n-1}$ and equals the velocity $v_n$ of the sheet metal 3 leaving the rolls in the stand $S_n$ and entering the work rolls 6 and 7 at the next stand $S_{n+1}$. The velocity $V_n$ of the sheet metal 3 leaving the stand $S_n$ is detected by the sheet metal velocity detector 23, and the output from the velocity detector 23 is applied to the lower work roll velocity comparator 24 and compared with the output from the lower work roll velocity control unit 22. The difference output signal from the comparator 24 is applied to the reduction control unit 25 which in turn controls the reduction pressure in such a way that the velocity of the lower work roll 7 may be always equal to the velocity $v_n$ of the sheet metal 3 leaving the stand $S_n$. Therefore the condition $V_n=v_n$ may be always satisfied.

In like manner, the velocities of the upper and lower work rolls 6 and 7 at the stand $S_{n-1}$ are controlled.

At the first stand $S_1$ the output from the upper work roll velocity control unit 8 and the output from the velocity detector 5 are compared by the velocity comparator 9, and the difference output signal from the comparator 9 is applied to the tension control unit 11 which controls the uncoiler 1 in such a way that the sheet metal velocity $v_O$ entering the work rolls 6 and 7 at the first stand $S_1$ may be always maintained equal to the velocity of the upper work roll 6. ($v_O=V_O$). In response to the output from the lower work roll velocity control unit 12 and the output from the sheet metal velocity detector 13; that is, in response to the difference output signal from the comparator 14, the reduction control unit 15 controls the reduction pressure or the gap between the upper and lower work rolls 6 and 7 in such a way that the velocity $V_1$ of the lower work roll 7 may be always maintained equal to the velocity of the sheet metal leaving the work wolls 6 and 7 at the first stand $S_1$ and entering the work rolls in the next stand.

When the velocities of the upper and lower work rolls and the velocity of the sheet metal entering or leaving the work rolls are controlled in the respective stands in the manner described above, the neutral points are located at the entering and exit points as shown in FIG. 3 in every stand so that the metal sheet may be rolled under a low rolling pressure into a final product having excellent surface qualities.

According to the present invention the velocity ratio of the upper and lower work rolls at respective stands is determined depending upon a desired elongation ratio (the ratio of the thickness of the sheet metal entering the work rolls to the thickness of the metal sheet leaving the work rolls) $\lambda_1-\lambda_{n+1}$, and the initial tension of the sheet metal entering the work rolls at the first stand determines all the tensions of the sheet metal entering and leaving the work rolls at respective stands.

It will be understood that various modifications may be effected without leaving the scope of the present invention. For instance, when the rolling direction is reversed from the recoiler to the uncoiler, the adjustments of tensions and reduction pressures or roll gaps are reversed. That is, the adjustments are started from the first stand and proceed to the last stand. Furthermore tension gages 34 may be disposed at the entraces to the stands after the first stand $S_1$ are connected to tension limiters 35 which in turn are connected to the tension control unit 33 as indicated by the two-dot chain lines so that when the tension detected by the tension gage 34 exceeds a reference tension level set in the tension limiter 35, the tension control unit 33 may operate in response to the output from the tension limiter 35 in manner substantially similar to that described above.

As described in detail hereinbefore with the continuous rolling mill in accordance with the present invention, the reduction pressure or the gap between the upper and lower work rolls and the tension exerted to the sheet metal to be rolled are so adjusted that the velocity of the sheet metal entering the work rolls may be equal to the velocity of the slower work roll while the velocity of the faster work roll may be equal to the velocity of the sheet metal leaving the work rolls. Therefore the following effects, features and advantages may be attained.

(I) The sheet metal may be rolled under a reduced rolling force without being wrapped around the work rolls.

(II) It is possible to wrap the sheet metal to be rolled around the work rolls of a single two-high rolling mill, but it is almost impossible to do so with a tandem rolling mill as described above. However according to the present invention the sheet metal may be passed from one rolling stand to another as in the conventional rolling mills, and may be rolled into a final product having excellent surface qualities same with or superior to those attainable by RD process.

(III) All of the problems and defects encountered in the process of wrapping the sheet metal around the work rolls may be completely overcome.

(IV) The tensions imparted to the sheet metal to be rolled are sequentially adjusted from the last stand to the first stand (or in the reversed order when the sheet metal is reversed) so that the velocity ratio between the upper and lower work rolls and the velocity ratio between the sheet metal entering or leaving the work rolls and the work rolls may be easily controlled.

I claim:

1. A rolling mill wherein a part of upper and lower work rolls are rotated at different peripheral velocities in order to maintain the peripheral velocity ratio of the work rolls substantially equal to an elongation ratio at which a sheet metal is rolled, the rolling mill comprising:

(a) velocity detecting means for detecting the velocities of the sheet metal entering and leaving one or each rolling mill stand;

(b) first work roll velocity control means for controlling the peripheral velocity of one of said pair of upper and lower work rolls which is rotated slower than the other;

(c) second work roll velocity control means for controlling the peripheral velocity of the other work roll;

(d) first velocity comparison means for comparing the peripheral velocity of said one work roll of a first mill stand with the velocity of said sheet metal entering the stand to generate a first correction signal representative of the difference between the entering sheet metal velocity and the one work roll peripheral velocity when there exists a difference therebetween, and first sheet metal tension control means responsive to said first correction signal for correcting the tension of the sheet metal entering the first mill stand, whereby the velocity of said sheet metal entering the first mill stand may be maintained substantially equal to the peripheral velocity of said one work roll of the stand;

(e) second velocity comparison means for comparing the peripheral velocity of said the other work roll with the velocity of said sheet metal leaving the rolling mill stand to generate a second correction signal representative of the difference between the leaving sheet metal velocity and the other work roll peripheral velocity when there exists a difference therebetween, and second sheet metal tension control means responsive to said second tension correction signal for correcting the tension of the sheet metal leaving the rolling stand, whereby the velocity of said sheet metal leaving the rolling mill stand may be maintained substantially equal to the peripheral velocity of said other work roll of the rolling mill stand; and (f) third sheet metal tension control means for controlling a recoiler so that the tension of the sheet metal leaving a last rolling mill stand may be maintained at a predetermined value.

* * * * *